United States Patent [19]

Datta et al.

[11] Patent Number: 4,921,767

[45] Date of Patent: May 1, 1990

[54] METHOD OF ELECTROPHOTOGRAPHICALLY MANUFACTURING A LUMINESCENT SCREEN ASSEMBLY FOR A CATHODE-RAY-TUBE

[75] Inventors: Pabitra Datta, Cranbury; Ronald N. Friel, Hamilton Square, both of N.J.

[73] Assignee: RCA Licensing Corp., Princeton, N.J.

[21] Appl. No.: 287,356

[22] Filed: Dec. 21, 1988

[51] Int. Cl.[5] ..... G03C 5/00

[52] U.S. Cl. ..... 430/23; 430/28; 430/29

[58] Field of Search ..... 430/23, 28, 29, 110

[56] References Cited

U.S. PATENT DOCUMENTS

| | | | |
|---|---|---|---|
| 1,495,487 | 5/1924 | Johnson | 427/71 |
| 2,625,734 | 1/1953 | Law | 445/4 |
| 2,682,478 | 6/1954 | Howse | 430/29 |
| 2,690,979 | 10/1954 | Law | 427/68 |
| 3,146,100 | 8/1964 | Kaufman | 430/97 |
| 3,475,169 | 10/1969 | Lange | 430/42 |
| 3,479,711 | 11/1969 | Heil | 445/30 |
| 3,483,010 | 12/1969 | Glovatsky et al. | 427/68 |
| 3,489,556 | 1/1970 | Drozd | 430/42 |
| 3,489,557 | 1/1970 | Lange et al. | 430/42 |
| 3,571,897 | 3/1971 | Heil | 445/73 |
| 3,856,518 | 12/1974 | Strik et al. | 430/25 |
| 4,245,020 | 1/1981 | van den Berg | 430/28 |
| 4,448,866 | 5/1984 | Olieslagers et al. | 430/24 |
| 4,480,021 | 10/1984 | Lu et al. | 430/110 |
| 4,496,641 | 1/1985 | van den Berg et al. | 430/23 |
| 4,563,409 | 1/1986 | Suzuki et al. | 430/110 |
| 4,605,283 | 8/1986 | Stanton | 350/127 |
| 4,620,133 | 10/1986 | Morrell et al. | 315/15 |
| 4,725,448 | 2/1988 | Fitzpatrick | 427/45.1 |
| 4,778,740 | 10/1988 | Takashima et al. | 430/42 |

FOREIGN PATENT DOCUMENTS

| | | | |
|---|---|---|---|
| 1008693 | 3/1983 | U.S.S.R. | 430/110 |

*Primary Examiner*—Paul R. Michl
*Assistant Examiner*—Jeffrey A. Lindeman
*Attorney, Agent, or Firm*—Eugene M. Whitacre; Dennis H. Irlbeck; Vincent J. Coughlin, Jr.

[57] ABSTRACT

The method of electrophotographically manufacturing a screen assembly on a substrate for use within a CRT, according to the present invention, includes the steps of sequentially coating a substrate with a conductive layer and an overcoating of a photoconductive layer, establishing an electrostatic charge on the photoconductive layer, and exposing selected areas of the photoconductive layer to visible light to affect the charge thereon. Then the photoconductive layer is developed with a charged screen structure material. The improved process utilizes a dry-powdered screen structure material having at least a surface charge control agent thereon to control the triboelectrical charging of the screen structure material.

10 Claims, 6 Drawing Sheets

*Electrophotographic Dry Phosphor Screening Process*

DEPOSIT
34
32
18

D.C. Volts
36
CHARGE
34
32
18

38
40
25
EXPOSE
34
32
18

Phosphors or Black Matrix
DEVELOP
18
32
34
42

23
FIX
34
32
18

Electrophotographic Dry Matrix Process

Electrophotographic Dry Phosphor Screening Process

METHOD OF ELECTROPHOTOGRAPHICALLY MANUFACTURING A LUMINESCENT SCREEN ASSEMBLY FOR A CATHODE-RAY-TUBE

The present invention relates to a method of electrophotographically manufacturing a screen assembly, and more particularly to manufacturing a screen assembly for a color cathode-ray tube (CRT) using triboelectrically charged, dry-powdered screen structure materials.

BACKGROUND OF THE INVENTION

A conventional shadow-mask-type CRT comprises an evacuated envelope having therein a viewing screen comprising an array of phosphor elements of three different emission colors arranged in a cyclic order, means for producing three convergent electron beams directed towards the screen, and a color selection structure or shadow mask comprising a thin multiapertured sheet of metal precisely disposed between the screen and the beam-producing means. The apertured metal sheet shadows the screen, and the differences in convergence angles permit the transmitted portions of each beam to selectively excite phosphor elements of the desired emission color. A matrix of light-absorptive material surrounds the phosphor elements.

In one prior art process for forming each array of phosphor elements on a viewing faceplate of the CRT, the inner surface of the faceplate is coated with a slurry of a photosensitive binder and phosphor particles adapted to emit light of one of the three emission colors. The slurry is dried to form a coating and a light field is projected from a source through the apertures in the shadow mask and onto the dried coating so that the shadow mask functions as a photographic master. The exposed coating is subsequently developed to produce the first color-emitting phosphor elements. The process is repeated for the second and third color-emitting phosphor elements, utilizing the same shadow mask but repositioning the light source for each exposure. Each position of the light source approximates the convergence angle of one of the electron beams which excites the respective color-emitting phosphor elements. A more complete description of this prior art process, known as the photolithographic wet process, can be found in U.S. Pat. No. 2,625,734 issued to H. B. Law on Jan. 20, 1953.

A drawback of the above-described wet process is that the process may not be capable of meeting the higher resolution demands of the next generation of entertainment devices and the even higher resolution requirements for monitors, work stations and applications requiring color alpha-numeric text. Additionally, the wet photolithographic process (including matrix processing) requires 182 major processing steps (shown in FIGS. 1 and 2, with the number under each block indicating the number of stations required), necessitates extensive plumbing and the use of clean water, requires phosphor salvage and reclamation, and utilizes large quantities of electrical energy for exposing and drying the phosphor materials.

U.S. Pat. No. 3,475,169 issued to H. G. Lange on Oct. 28, 1969 discloses a process for electrophotographically screening color cathode-ray tubes. The inner surface of the faceplate of the CRT is coated with a volatilizable conductive material and then overcoated with a layer of volatilizable photoconductive material. The photoconductive layer is then uniformly charged, selectively exposed with light through the shadow mask to establish a latent charge image, and developed using a high molecular weight carrier liquid bearing, in suspension, a quantity of phosphor particles of a given emissive color that are selectively deposited onto suitably charged areas of the photoconductive layer to develop the latent image. The charging, exposing and deposition process is repeated for each of the three color-emissive phosphors, i.e., green, blue, and red, of the screen. An improvement in electrophotographic screening is described in U.S. Pat. No. 4,448,866 issued to H. G. Olieslagers, et al. on May 15, 1984. In the latter patented process, phospher particle adhesion is said to be increased by uniformly exposing, with light, the portions of the photoconductive layer lying between the deposited pattern of phosphor particles after each deposition step to reduce or discharge any residual charge and to permit a more uniform recharging of the photoconductor for subsequent depositions. Since the latter two patents disclose an electrophotographic process that is, in essence, a wet process, many of the drawbacks described above, with respect to the wet photolithographic process of U.S. Pat. No. 2,625,734 also are applicable to the wet electrophotographic process.

The process of the present invention is a dry electrophotographic process which eliminates or minimizes many of the drawbacks of the prior art processes.

SUMMARY OF THE INVENTION

The method of electrophotographically manufacturing a screen assembly on a substrate for use within a CRT, according to the present invention, includes the steps of sequentially coating a substrate with a conductive layer and an overcoating of a photoconductive layer, establishing an electrostatic charge on the photoconductive layer, and exposing selected areas of the photoconductive layer to visible light to affect the charge thereon. Then the photoconductive layer is developed with a charged screen structure material. The improved process utilizes a dry-powdered screen structure material having at least a surface charge control agent thereon to control the triboelectrical charging of the screen structure material.

DETAILED DESCRIPTION OF THE PREFERRED EMBODIMENT

Figure 1:
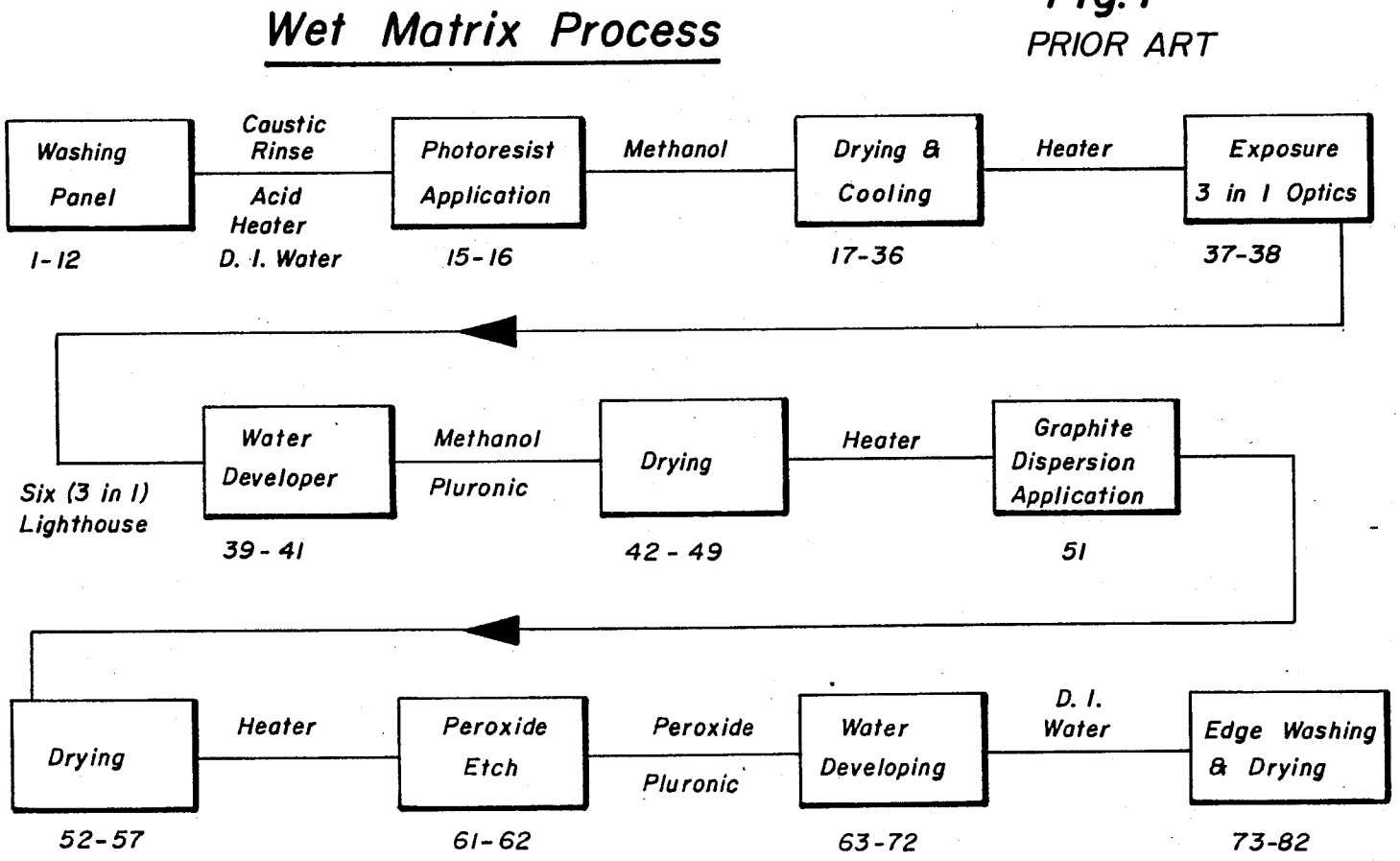
Fig. 1 PRIOR ART
FIG. 1 is a block diagram of a conventional wet black matrix process.
Figure 2:
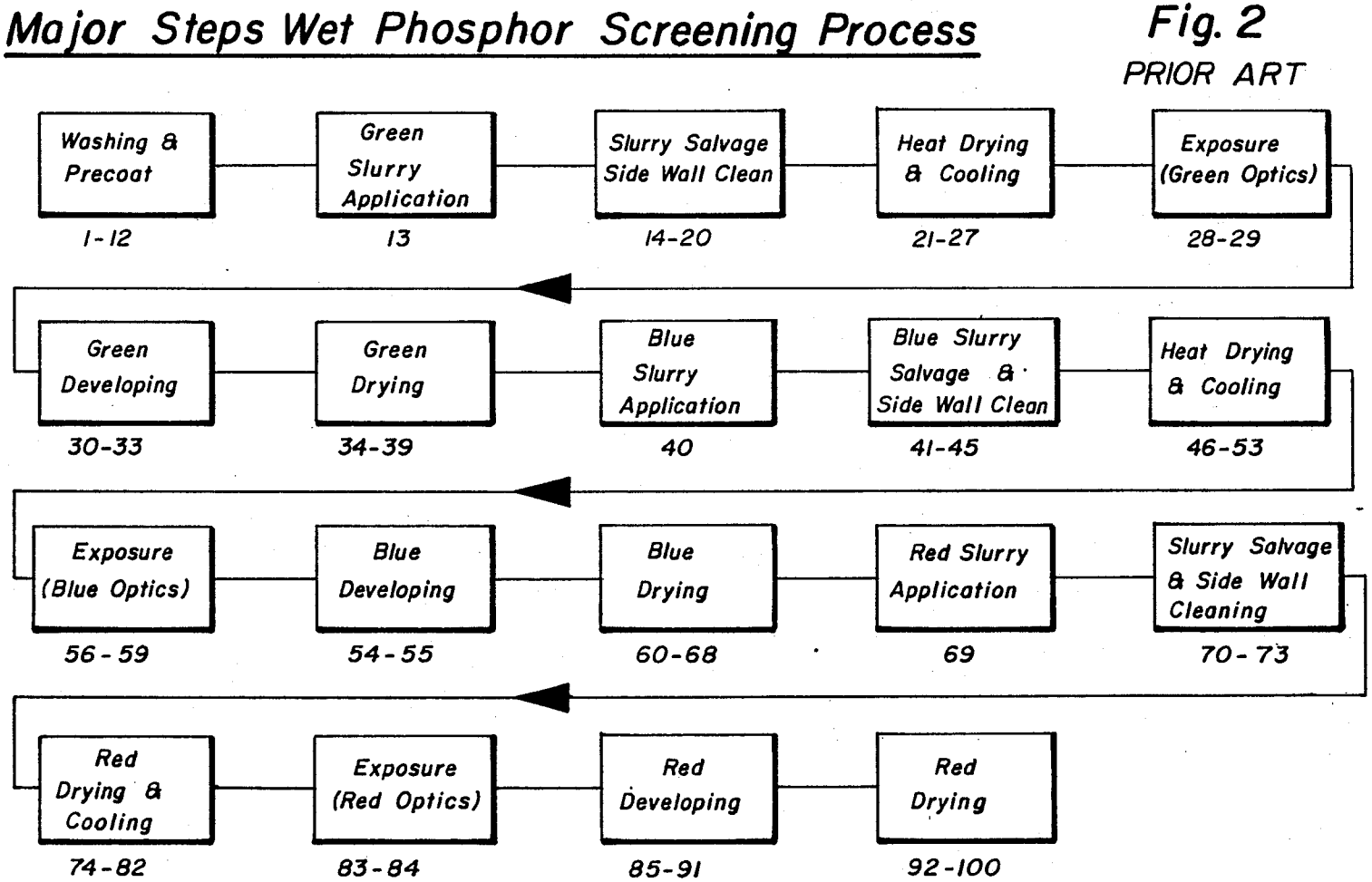
Fig. 2 PRIOR ART
FIG. 2 is a block diagram of the major steps in a conventional wet phosphor screening process.
Figure 3:
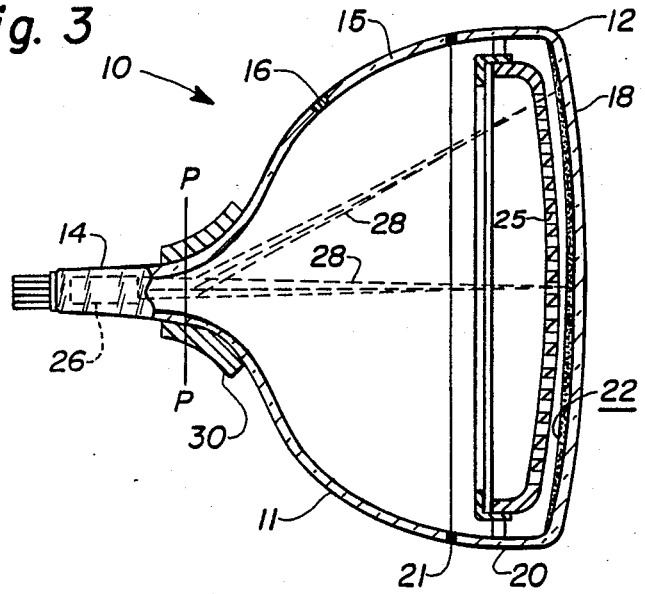
FIG. 3 is a plan view partially in axial section of a color cathode-ray tube made according to the present invention.
Figure 4:
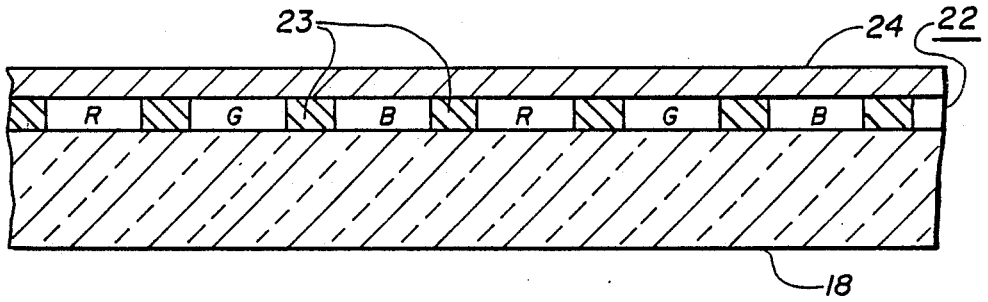
FIG. 4 is a section of a screen assembly of the tube shown in FIG. 3.

FIG. 3 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color phosphor screen 22 is carried on the inner surface of the faceplate 18. The screen 22, shown in FIG. 4, preferably is a line screen which includes a multiplicity of screen elements comprised of red-emitting, green-emitting and blue-emitting phosphor stripes R, G and B, respectively, arranged in color groups or picture elements of three stripes or triads in a cyclic order and extending in a direction which is generally normal to the plane in which the electron beams are generated. In the normal viewing position for this embodiment, the phosphor stripes extend in the vertical direction. Preferably, the phosphor stripes are separated from each other by a light-absorptive matrix material 23 as is known in the art. Alternatively, the screen can be a dot screen. A thin conductive layer 24, preferably of aluminum, overlies the screen 22 and provides a means for applying a uniform potential to the screen as well as reflecting light, emitted from the phosphor elements, through the faceplate 18. The screen 22 and the overlying aluminum layer 24 comprise a screen assembly.

Again with respect to FIG. 3, a multi-apertured color selection electrode or shadow mask 25 is removably mounted, by conventional means, in predetermined space relation to the screen assembly. An electron gun 26, shown schematically by the dashed lines in FIG. 3, is centrally mounted within the neck 14, to generate and direct three electron beams 28 along convergent paths through the apertures in the mask 25 to the screen 22. The gun 26 may, for example, comprise a bi-potential electron gun of the type described in U.S. Pat. No. 4,620,133 issued to Morrell et al. on Oct. 28, 1986, or any other suitable gun.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 3 at about the middle of the yoke 30. For simplicity, the actual curvatures of the deflection beam paths in the deflection zone are not shown.

Figures 5A, 5B, 5C, 5D, 5E:
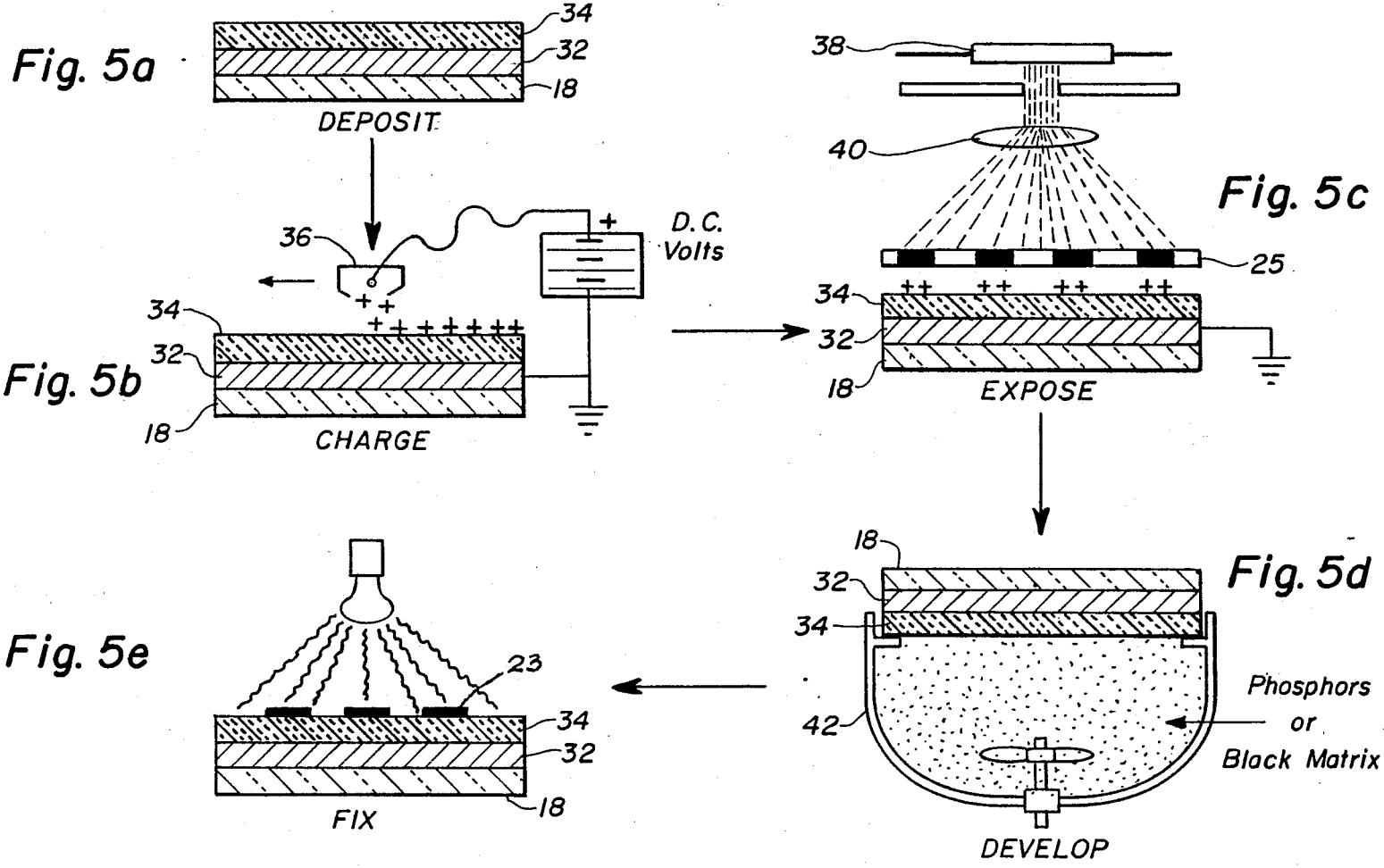
FIG. 5*a* shows a portion of a CRT faceplate having a conductive layer and a photoconductive layer thereon.
FIG. 5*b* shows the charging of the photoconductive layer on the CRT faceplate shown in FIG. 5*a*.
FIG. 5*c* shows the CRT faceplate and a portion of a shadow mask during a subsequent exposure step in the screen manufacturing process.
FIG. 5*d* shows the CRT faceplate during a develop step in the screen manufacturing process.
FIG. 5*e* shows the partially completed CRT faceplate during a later fixing step in the screen manufacturing process.
Figure 6:
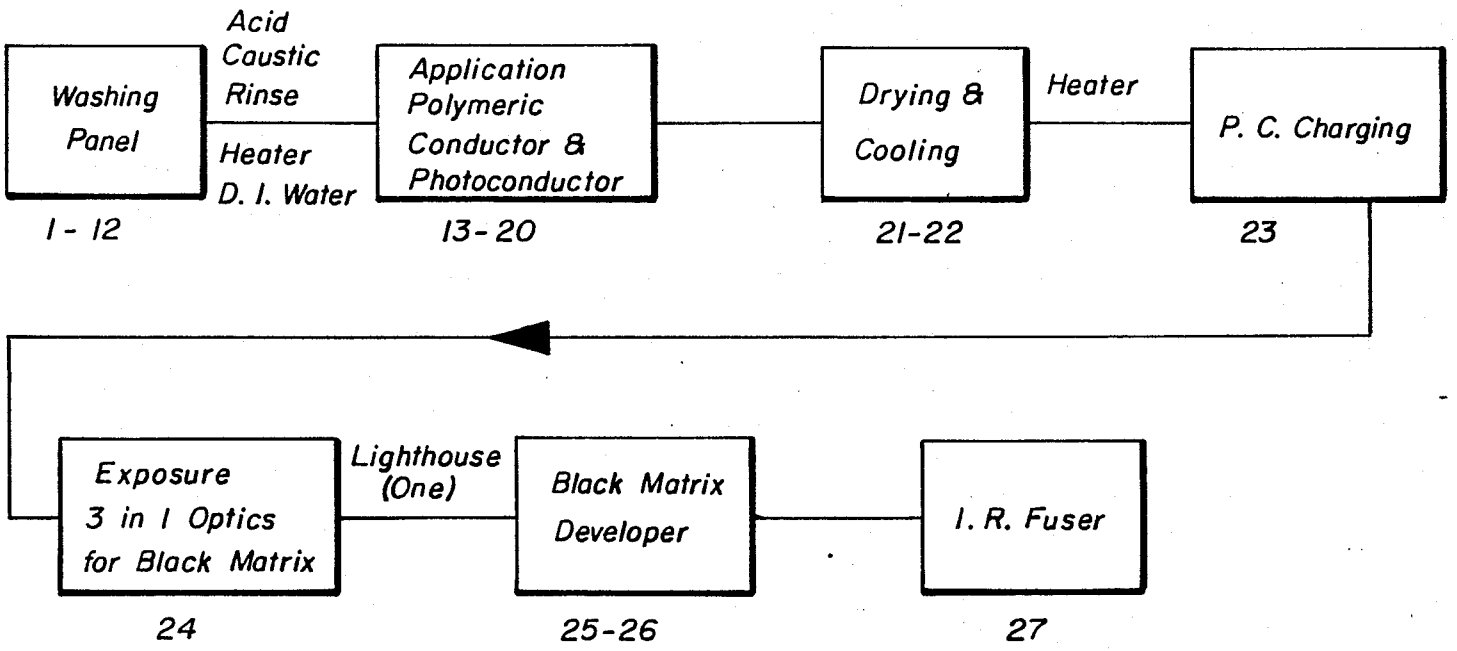
FIG. 6 is a block diagram of the present electrophotographic dry matrix process.
Figure 7:
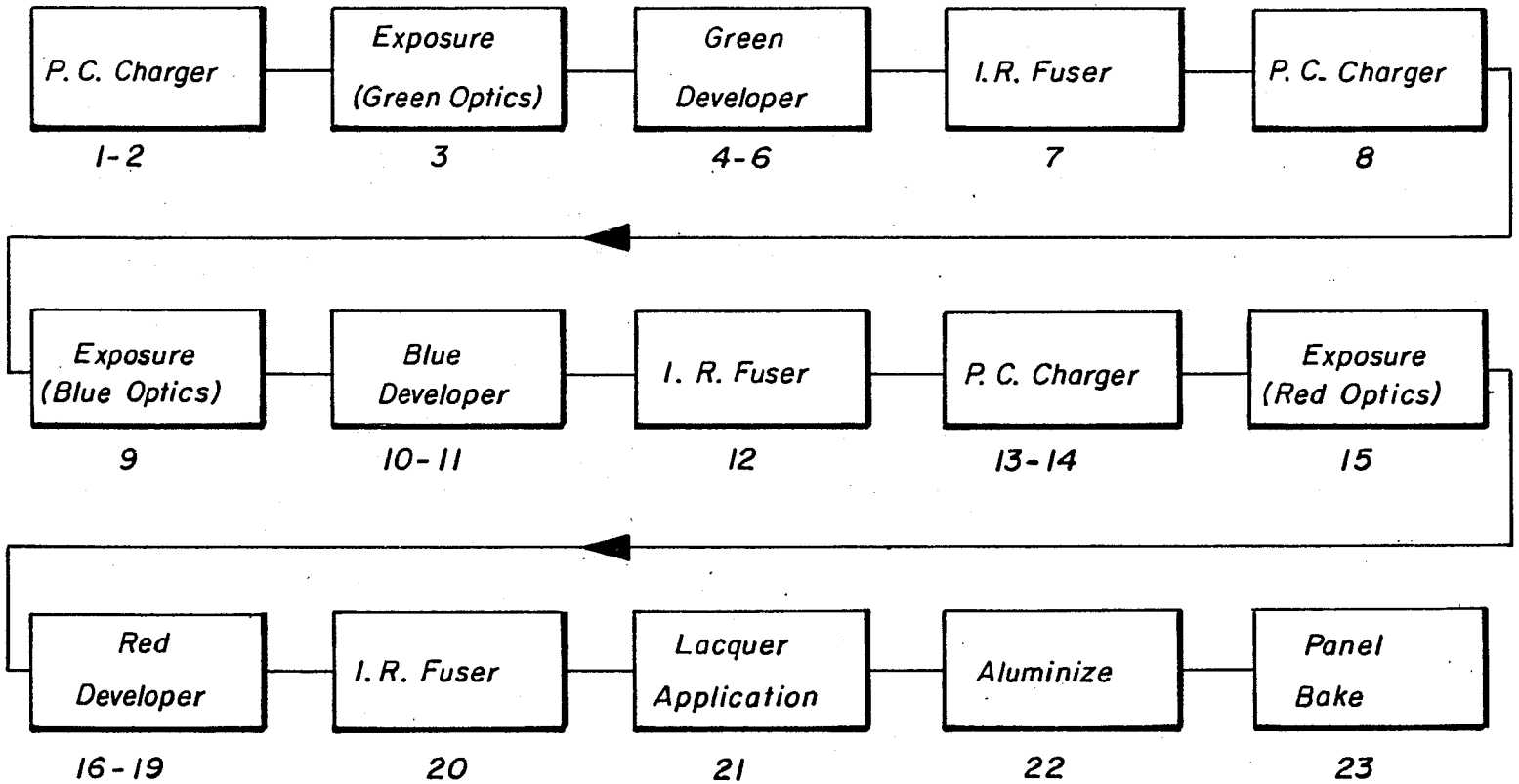
FIG. 7 is a block diagram of the present electrophotographic dry phosphor screening and screen assembly process.

The screen 22 is manufactured by a novel electrophotographic process that is schematically represented in FIGS. 5*a* through 5*e* and in the block diagrams of FIGS. 6 and 7. Initially, the panel 12 is washed with a caustic solution, rinsed with water, etched with buffered hydrofluoric acid and rinsed once again with water as is known in the art. The inner surface of the viewing faceplate 18 is then coated with a layer 32 of an electrically conductive material which provides an electrode for an overlying photoconductive layer 34. The conductive layer 32 can be an inorganic conductor such as tin oxide or indium oxide, or a mixed indium-tin oxide or, preferably, a volatilizable organic conductive material consisting of a polyelectrolyte commercially known as Polybrene (1,5-dimethy-1,5-diaza-undecamethylene polymethobromide, hexadimethrine bromide) or another quaternary ammonium salt. Polybrene, available from Aldrich Chemical Co., Milwaukee, Wisc., is suitably applied to the inner surface of the viewing faceplate 18 in an aqueous solution containing about 10 percent by weight of propanol and about 10 percent by weight of a water soluable, adhesion promoting polymer such as poly (vinyl alcohol), polyacrylic acid, certain polyamides and the like. The conductive preparation is conventionally applied to the facelate 18, as by spin-coating, and dried to provide a layer having a thickness from about 1 to 2 microns and a surface resistivity of less than about $10^8$ ohms per square unit.

The conductive layer 32 is coated with the photoconductive layer 34 comprising a volatilizable organic polymeric material, a suitable photoconductive dye and a solvent. The polymeric material is preferably an organic polymer such as polyvinyl carbazole, or an organic monomer such as n-ethyl carbazole, n-vinyl carbazole or tetraphenylbutatriene dissolved in a polymeric binder such as polymethylmethacrylate or polypropylene carbonate.

THe dye component may be any photoconductive dye which is soluble in the solvents utilized, remains stable under the processing conditions described herein and which is sensitive to light in the visible spectrum, preferably from about 400 to 700 nm. Suitable dyes include crystal violet, chloridine blue, rhodamine EG and the like. The dye is typically present in the photoconductive composition in from about 0.1 to 0.4 percent by weight. The solvent for the photoconductive composition is an organic such as chlorobenzene or cyclopentanone and the like which will produce as little cross contamination as possible between the layers 32 and 34. The photoconductive composition is conventionally applied to the conductive layer 32, as by spin coating, and dried to form a layer having a thickness from about 2 to 6 microns.

In accordance with the invention, the photoconductive layer 34 overlying the conductive layer 32 is charged in a dark environment by a conventional positive corona discharge apparatus 36, schematically shown in FIG. 5*b*, which moves across the layer 34 and charges it within the range of +200 to +700 volts although +200 to +400 volts is preferred. The shadow mask 25 is inserted in the panel 12 and the positively charged photoconductor is exposed through the shadow mask, to the light from a xenon flash lamp 38 disposed within a conventional three-in-one lighthouse (represented by lens 40 of FIG. 5*c*). After each exposure, the lamp is moved to a different position to duplicate the incident angle of the electron beams from the electron gun. Three exposures are required, from three different lamp positions, to discharge the areas of the photoconductor where the light-emitting phosphors will subsequently be deposited to form the screen. After the exposure step, the shadow mask 25 is removed from the panel 12 and the panel is moved to a first developer 42 (FIG. 5*d*) containing suitably prepared dry-powdered particles of a light-absorptive black matrix screen structure material, and surface treated insulative carrier beads (not shown) which have a diameter of about 100 to 300 microns and which impart triboelectrical charge to the particles of black matrix material.

The surface treatment of the carrier beads is described in our copending patent application Ser. No. 287,357 entitled METHOD OF SURFACE TREATMENT OF CARRIER BEADS FOR USE IN ELECTROPHOTOGRAPHIC SCREEN PROCESSING, filed on Dec. 21, 1988 and assigned to the assignee of the present invention. The aforementioned patent application is incorporated by reference herein for the purpose of disclosure.

Suitable black matrix materials generally contain black pigments which are stable at a tube processing temperature of 450° C. Black pigments suitable for use in making matrix materials include: iron manganese oxide (Bayferro Black 303T, available from the Mobay Chemical Corp., Pittsburg, Pa.), iron cobalt oxide, zinc iron sulfide and insulating carbon black. The black matrix material is prepared by melt-blending the pigment, a polymer and a suitable charge control agent which controls the magnitude of the triboelectric charge imparted to the matrix material. The material is ground to an average particle size of about 5 microns. The polymer is selected from the group consisting of butylacrylate, styrene-butylacrylate copolymer, methylmethacrylate-butylmethacrylate copolymer, polyvinyl alcohol, Polyester (poly [polyethylene 1,4-cyclohexanedicarboxylate-terephthalate-1,4-oxybenzoate]) and polyamides (Union Camp Co., Unirez 2205, 2209, 2218, 1548). Suitable agents that may be used for controlling the negative charge on the matrix particles comprise organic acids such as naphthalene sulphonic acid, bis-benzene sulfonamide, or p-toluene sulfonic acid, and dyes and pigments, such as the chromium complexes of 1-phenylazo-2-naphthols.

The black matrix material and the surface-treated carrier beads, coated with a thin film of a charge-control agent, are mixed in the developer 42 using about 1 to 2 percent by weight of black matrix material. The materials are mixed so that the finely divided matrix particles contact and are charged negatively by the surface-treated carrier beads. The negatively charged matrix material particles are expelled from the developer 42 and attracted to the positively charged, unexposed area of the photoconductive layer 34 to directly develop that area. Infrared radiation is then used to fix the matrix material by melting or thermally bonding the polymer component of the matrix material to the photoconductive layer to form the matrix 23. See FIGS. 4 and 5*e*.

The photoconductive layer 34 containing the matrix 23 is uniformly recharged to a positive potential of about 200 to 400 volts for the application of the first of three color-emmissive, dry-powdered phosphor screen structure materials. The shadow mask 25 is reinserted into the panel 12 and selective areas of the photoconductive layer 34, corresponding to the locations where green-emitting phosphor material will be deposited, are exposed to visible light from a first location within the lighthouse to selectively discharge the exposed areas. The first light location approximates the convergence angle of the green phosphor-impinging electron beam. The shadow mask 25 is removed from the panel 12 and the panel is moved to a second developer 42 containing suitably prepared dry-powdered particles of green-emitting phosphor screen structure material. The phosphor particles are surface treated with a suitable charge controlling material as described in copending patent applications Ser. Nos. 287,358 and 287,355 entitled: SURFACE TREATMENT OF PHOSPHOR PARTICLES AND METHOD, and SURFACE TREATMENT OF SILICA COATED PHOSPHOR PARTICLES AND METHOD FOR A CRT SCREEN, respectively, filed on Dec. 21, 1988, assigned to the assignee of the present invention and incorporated by reference herein for the purpose of disclosure. One preferred coating material is a gelatin or similar polymer coating formed by a method described in the first above-mentioned patent application. The gelatin encapsulates the phosphor particles and provides an amide functional group which is triboelectrically positive when mixed with organoflurosilane-treated carrier beads. One Thousand (1000) grams of surface-treated carrier beads are combined with 15 to 25 grams of surface-treated phosphor particles in the second developer 42. The positively charged green-emitting phosphor particles are expelled from the developer, repelled by the positively charged areas of the photoconductive layer 34 and matrix 23, and deposited onto the discharged, light-exposed areas of the photoconductive layer in a process known as reversal developing. The deposited green-emitting phosphor particles are fixed to the photoconductive layer as described hereinafter.

The photoconductive layer 34, matrix 23 and green phosphor layer are uniformly recharged to a positive potential of about 200 to 400 volts for the application of the blue-emitting phosphor screen structure material. The shadow mask is reinserted into the panel 12 and selective areas of the photoconductive layer 34 are exposed to visible light from a second position within the lighthouse, which approximates the convergence angle of the blue phosphor-impinging electron beam, to selectively discharge the exposed areas. The shadow mask 25 is removed from the panel 12 and the panel is moved to a third developer 42 containing suitably prepared dry-powdered particles of blue-emitting phosphor screen structure material. The phosphor particles are surface-treated, as described above, with a suitable charge controlling material, such as gelatin, which provides a positive charge on the phosphor particles when mixed, as described above, with suitably prepared surface-treated carrier beads. The triboelectrically positively charged, dry-powdered, blue-emitting, phosphor particles are expelled from the third developer 42, repelled by the positively charged areas of the photoconductive layer 34, the matrix 23 and the green phosphor material, and deposited onto the discharged, light-exposed areas of the photoconductive layer. The deposited blue-emitting phosphor particles are fixed, as described hereinafter, to the photoconductive layer.

The process of charging, exposing, developing and fixing is repeated again for the dry-powdered, red-emitting, surface treated phosphor particles of screen structure material. The exposure to visible light, to selectively discharge the positively charged areas of the photoconductive layer 34, is from a third position within the lighthouse, which approximates the convergence angle of the red phosphor-impinging electron beam. The triboelectrically positively charged, dry-powdered, red-emitting phosphor particles are mixed with the surface-treated carrier beads in the ratio described above and expelled from a fourth developer 42, repelled by the positively charged areas of the previously deposited screen structure materials, and deposited on the discharged areas of the photoconductive layer 34.

The phosphors are fixed by exposing each successive deposition of light-emitting phosphor material to infrared radiation which melts or thermally bonds the polymer component to the photoconductive layer. Subsequent to the fixing of the red-emitting phosphor material, a spray film of lacquer is applied by conventional means to the screen structure materials and then a thin film of aluminum is vapor deposited onto the lacquer film, as is known in the art.

The faceplate panel 12 is baked in air at a temperature of 425° C. for about 30 minutes to drive off the volatilizable constituents of the screen including the conductive layer 32, the photoconductive layer 34, the solvents present in both the screen structure materials and in the filming lacquer. The resultant screen assembly possess high resolution (up to 0.1 mm line width obtained using a resolution target), higher light output than a conventional wet processed screen, and greater color purity because of less cross-contamination of the phosphor materials.

The manufacturing time required for dry electrophotographically processed screens is less than that of conventional wet processed screens. The dry process requires no drying steps and the photoconductive layer is orders of magnitude more sensitive than the materials used in the wet process so that only milliseconds of exposure to a xenon flash lamp are required to perform the exposure steps. Additionally, the lighthouses require no additionally cooling because of the brief exposure times so that thermal degradation and misalignment are eliminated. The novel process thus permits a higher output of product using a cleaner, more efficient process and provides a significant reduction in cost.

It should be clear to one skilled in the art that the present process can be modified within the scope of the present invention. For example, the photoconductive layer can be charged negatively and after exposure to three color fields the negatively charged pattern can be developed with positively charged dry-powdered black matrix material. The phosphor particles can also be negatively charged depending upon the material used on the carrier beads and phosphor particles to control the triboelectric charge. Alternatively, a conventional wet deposition process may be used to form the light-absorptive black matrix and then the novel electrophotographic process may be used to deposit triboelectrically charged, dry-powdered phosphor materials.

What is claimed is:

1. In a method of electrophotographically manufacturing a luminescent screen assembly on an interior surface of a faceplate panel for a color CRT comprising the steps of:

(a) coating said surface of said panel with a volatilizable conductive layer;

(b) overcoating said conductive layer with a volatilizable photoconductive layer including a dye sensitive to visible light;

(c) establishing a substantially uniform electrostatic charge on said photoconductive layer;

(d) exposing selected areas of said photoconductive layer to visible light to affect the charge thereon;

(e) applying a triboelectrically charged first color-emitting phosphor onto said exposed, selected areas of said photoconductive layer;

(f) fixing said first color-emitting phosphor to said photoconductive layer;

(g) repeating steps c, d, e and f, consecutively, for a triboelectrically charged second and third color-emitting phosphors to form a luminescent screen comprising picture elements of triads of color-emitting phosphors;

(h) aluminizing said luminescent screen; and (i) baking said faceplate panel to remove the volatilizable constituents from said luminescent screen to form said luminescent screen assembly, the improvement wherein said phosphor materials comprise dry-powdered particles having at least a surface charge control agent thereon to control the triboelectrical charging thereof.

2. The method of claim 1, wherein subsequent to step (d), first iteration, the method includes the additional steps of:

developing the unexposed areas of said photoconductive layer with triboelectrically charged, dry-powdered light-absorptive screen structure material including a polymer and a charge control agent;

fixing said light-absorptive screen structure material; and reestablishing a substantially uniform electrostatic charge on said photoconductive layer and on said light-absorptive screen structure material.

3. The method of claim 1, wherein prior to step (a) the method includes the preliminary step of forming a conventional light-absorptive matrix pattern on said interior surface of said faceplate panel.

4. The method of claim 1, wherein the fixing of step (f) comprises thermally bonding said phosphor to said photoconductive layer.

5. The method of claim 4, wherein the step of thermally bonding is provided by irradiating said phosphor with infrared radiation.

6. The method of claim 2, wherein said fixing step includes exposing said light-absorptive screen structure material to infrared radiation to bond said material to said photoconductive layer.

7. A method of electrophotographically manufacturing a luminescent screen assembly on an interior surface of a faceplate panel for a color CRT comprising the steps of:

(a) coating said surface of said panel with a volatilizable conductive layer;

(b) overcoating said conductive layer with a volatilizable photoconductive layer including a dye sensitive to visible light, said dye being selected from the group consisting of crystal violet, chloridine blue and rhodamine EG;

(c) establishing a substantially uniform electrostatic charge on said photoconductive layer;

(d) exposing, through a mask, selected areas of said photoconductive layer to visible light from a xenon lamp to affect the charge on said photoconductive layer;

(e) directly developing the unexposed areas of the photoconductive layer with a triboelectrically charged, dry-powdered light-absorptive screen structure material including a polymer and a charge control agent, the charge on said screen structure material being of opposite polarity to the charge on the unexposed areas of the photoconductive layer;

(f) fixing said screen structure material by thermally bonding said screen structure material to said photoconductive layer;

(g) reestablishing a substantially uniform electrostatic charge on said photoconductive layer and on said screen structure material;

(h) exposing, through said mask, first portions of said selected areas of said photoconductive layer to visible light from said lamp to affect the charge on said photoconductive layer;

(i) reversal developing the first portions of said selected areas of said photoconductive layer with a triboelctrically charged, dry-powdered, first color-emitting phosphor screen structure material, said first color-emitting phosphor having at least a surface charge control agent thereon to provide a charge of the same polarity as that on the unexposed areas of said photoconductive layer and on said light-absorptive screen structure material to repel said first color-emitting phosphor therefrom;

(j) fixing said first color-emitting phosphor material to the first portions of said selected areas of said photoconductive layer;

(k) repeating steps g, h, i and j, consecutively, for triboelectrically charged, dry-powdered second and third color-emitting phosphor screen structure materials each having at least a surface charge control agent thereon, thereby forming a luminescent screen comprising picture elements of triads of color-emitting phosphors;

(l) aluminizing said luminescent screen; and (m) baking said faceplate panel to remove volatilizable constituents from said screen to form said luminescent screen assembly.

8. In a method of electrophotographically manufacturing a luminescent screen assembly on an interior surface of a faceplate panel for a color CRT comprising the steps of:

(a) coating said surface of said panel with a volatilizable conductive layer;

(b) overcoating said conductive layer with a volatilizable photoconductive layer including a dye sensitive to visible light;

(c) establishing a substantially uniform electrostatic charge on said photoconductive layer;

(d) exposing, through a mask, selected areas of said photoconductive layer to visible light to affect the charge thereon;

(e) directly developing the unexposed areas of said photoconductive layer with a triboelectrically charged, dry-powdered, light-absorptive screen structure material;

(f) fixing said screen structure material to said photoconductive layer;

(g) reestablishing a substantially uniform electrostatic charge on said photoconductive layer and on said light-absorptive screen structure material;

(h) exposing, through said mask, first portions of selected areas of said photoconductive layer to visible to affect the charge on said photoconductive layer;

(i) reversal developing the first portions of said selected areas on said photoconductive layer with a triboelectrically charged, dry-powdered, first color-emitting phosphor screen structure material having a surface charge control agent thereon;

(j) fixing said first color-emitting phosphor material to the first portions of said selected areas of said photoconductive layer;

(k) repeating steps g, h, i and j, consecutively, for triboelectrically charged, dry-powdered second and third color-emitting phosphor screen structure materials having at least a surface charge control agent thereon, thereby forming a luminescent screen comprising picture elements of triads of color-emitting phosphor materials;

(l) aluminizing said luminescent screen; and (m) baking said faceplate panel to remove volatilizable constituents from said screen to form said luminescent screen assembly.

9. The method of claim 8, wherein the fixing steps, (f) and (j) comprise thermal bonding of said materials to said photoconductive layer.

10. The method of claim 9, wherein thermal bonding is provided by irradiating said materials with infrared radiation.

* * * * *

UNITED STATES PATENT AND TRADEMARK OFFICE
CERTIFICATE OF CORRECTION

PATENT NO. : 4,921,767

DATED : May 1, 1990

INVENTOR(S) : Pabitra Datta and Ronald N. Friel

It is certified that error appears in the above-identified patent and that said Letters Patent is hereby corrected as shown below:

Title, cover page and
Col. 1, line 3, change
"CATHODE-RAY-TUBE" to
--CATHODE-RAY TUBE--.

Col. 4, line 27,
change "THe" to --The--.

Col. 6, line 1,
after "METHOD"
add --FOR A CRT SCREEN--.

Col. 10, line 15,
after "visible" add --light--.

Signed and Sealed this

Fourteenth Day of January, 1992

*Attest:*

HARRY F. MANBECK, JR.

*Attesting Officer*

*Commissioner of Patents and Trademarks*